US011903413B2

(12) United States Patent
Bonnely et al.

(10) Patent No.: US 11,903,413 B2
(45) Date of Patent: Feb. 20, 2024

(54) SHISHA CONSUMABLE ARTICLE

(71) Applicant: PHILIP MORRIS PRODUCTS S.A., Neuchatel (CH)

(72) Inventors: Samuel Bonnely, Cormondrèche (CH); Angelos Kolyris, St-Sulpice (CH); Stuart Michael Ruan Jones, Royston (GB); John Antony Stephenson, Cambridge (GB); Yaan Thomas Kinally, Cambridge (GB); Michael Paton, Royston (GB); David Cross, Letchworth (GB); Didier Goedertier, Dendermonde (BE); Francois Ceppi, Sugiez (CH)

(73) Assignee: Philip Morris Products S.A., Neuchatel (CH)

( * ) Notice: Subject to any disclaimer, the term of this patent is extended or adjusted under 35 U.S.C. 154(b) by 158 days.

(21) Appl. No.: 16/090,901

(22) PCT Filed: Apr. 5, 2017

(86) PCT No.: PCT/IB2017/051963
§ 371 (c)(1),
(2) Date: Oct. 3, 2018

(87) PCT Pub. No.: WO2017/178930
PCT Pub. Date: Oct. 19, 2017

(65) Prior Publication Data

US 2019/0124977 A1 May 2, 2019

(30) Foreign Application Priority Data

Apr. 11, 2016 (EP) ..... 16164760

(51) Int. Cl.
*A24F 1/30* (2006.01)
*A24F 42/10* (2020.01)
*A24D 1/22* (2020.01)

(52) U.S. Cl.
CPC ..... *A24F 1/30* (2013.01); *A24D 1/22* (2020.01); *A24F 42/10* (2020.01)

(58) Field of Classification Search
CPC ..... A24F 47/006; A24F 1/30; A24F 42/60
(Continued)

(56) References Cited

U.S. PATENT DOCUMENTS 7,766,018 B2 * 8/2010 Roth ..... A24F 47/002 131/273
8,347,892 B2 * 1/2013 Mehio ..... A24F 1/30 131/348
(Continued)

FOREIGN PATENT DOCUMENTS

CN 2807811 Y 8/2006
CN 201061260 5/2008
(Continued)

OTHER PUBLICATIONS

Definition of Compartment, Merriam-Webster Dictionary, https://www.merriam-webster.com/dictionary/compartment (Year: 2021).*
(Continued)

*Primary Examiner* — Russell E Sparks
(74) *Attorney, Agent, or Firm* — Mueting Raasch Group

(57) ABSTRACT

A shisha consumable article (101) for use with an external assembly such as a shisha assembly is described. The shisha consumable article includes a housing (110) defining a first compartment (112) and a second compartment (114) being adjacent to the first compartment. The second compartment is adjacent to, and sealed or air impermeable from, the first compartment. A combustible heat source (120) is contained
(Continued)

within the first compartment and an aerosol-forming substrate (130) is contained within the second compartment.

13 Claims, 13 Drawing Sheets

(58) Field of Classification Search
USPC ..... 131/329
See application file for complete search history.

(56) References Cited

U.S. PATENT DOCUMENTS

| | | | | |
|---|---|---|---|---|
| 8,490,630 | B2 * | 7/2013 | Boutros | A24F 1/30 131/226 |
| 9,282,772 | B2 * | 3/2016 | Tucker | H05B 1/0244 |
| 9,888,724 | B2 * | 2/2018 | Cameron | G06F 3/165 |
| 10,064,430 | B2 * | 9/2018 | Ugurhan | A24F 1/30 |
| 10,471,223 | B2 * | 11/2019 | Bourque | G16H 40/63 |
| 2008/0060663 | A1 | 3/2008 | Bassam et al. | |
| 2009/0178686 | A1 | 7/2009 | Nefraoui | |
| 2010/0101590 | A1 | 4/2010 | Pflaum | |
| 2013/0014755 | A1 * | 1/2013 | Kumar | A24F 42/60 128/202.21 |
| 2014/0069446 | A1 * | 3/2014 | Haddad | A24F 1/30 427/2.14 |
| 2015/0040924 | A1 * | 2/2015 | Mironov | A24D 1/22 131/328 |
| 2015/0075544 | A1 | 3/2015 | Portz et al. | |
| 2015/0272214 | A1 | 10/2015 | Giller | |
| 2015/0296882 | A1 | 10/2015 | Mironov et al. | |
| 2016/0037825 | A1 * | 2/2016 | Stein | A24D 1/14 131/226 |

FOREIGN PATENT DOCUMENTS

| | | | | | |
|---|---|---|---|---|---|
| CN | 201270758 | Y | | 7/2009 | |
| CN | 201451340 | | | 5/2010 | |
| CN | 104244748 | A | | 12/2014 | |
| CN | 104287091 | | | 1/2015 | |
| EP | 2161217 | A1 | | 3/2010 | |
| EP | 2179667 | | | 4/2010 | |
| GB | 2490352 | A | * | 10/2012 | A24D 1/14 |
| GB | 2490352 | A | | 10/2012 | |
| WO | WO 2004/064548 | A1 | | 8/2004 | |
| WO | WO 2012/164077 | A1 | | 12/2012 | |
| WO | 2013120854 | | | 8/2013 | |
| WO | WO-2014086998 | A1 | * | 6/2014 | A24C 5/54 |
| WO | WO 2015/024697 | A1 | | 2/2015 | |
| WO | WO-2015022317 | A1 | * | 2/2015 | A24B 15/165 |

OTHER PUBLICATIONS

Definition of Contain, Merriam-Webster Dictionary, https://www.merriam-webster.com/dictionary/contain (Year: 2021).*

International Preliminary Report on Patentability received in PCT/IB2017/051963, issued by the International Bureau of WIPO dated Oct. 25, 2018; 7 pgs.

International Search Report and Written Opinion for PCT/IB2017/051963, issued by the European Patent Office, dated Jun. 23, 2017; 13 pgs.

European Search Report from the European Patent Office for EP Application No. 16164760.7, dated Oct. 11, 2016; 6 pgs.

Chinese Office Action received in CN Application No. 201780018155.X, dated Oct. 27, 2020 by the China National Intellectual Property Administration, 15 pgs. including English Translation.

Chinese Office Action for CN Application No. 201780018155.X, issued by the China National Intellectual Property Administration dated Jul. 2, 2021; 18 pgs. including English translation.

Chinese Notice of Allowance for CN Application No. 201780018155.X, issued by the China National Intellectual Property Administration dated Jan. 11, 2022; 4 pgs.

* cited by examiner

SHISHA CONSUMABLE ARTICLE

This application is the § 371 U.S. National Stage of International Application No. PCT/IB2017/051963, filed 5 Apr. 2017, which claims the benefit of European Application No. 16164760.7, filed 11 Apr. 2017.

This disclosure relates to a shisha consumable article containing a combustible heat source and an aerosol-forming substrate. The shisha consumable article may be for use with an external assembly such as a shisha assembly.

Shisha devices are used to smoke tobacco and are configured such that vapour and smoke pass through a volume of water before being inhaled by a consumer. A shisha device includes a bowl containing tobacco beneath a glass or metal screen. Charcoal is placed on the glass or metal screen and lit. When one inhales through the shisha device, air is pulled through the charcoal and into the bowl holding the tobacco. The hot air, heated by the charcoal vaporizes the tobacco without burning it. The vapor is passed down through a conduit that extends into the volume of water. It bubbles up through the water, losing heat, and fills the top part of the vessel, to which the mouthpiece hose is attached. When a smoker inhales from the mouthpiece, smoke passes into the lungs, and the change in pressure in the jar pulls more air through the charcoal, continuing the process.

Shisha devices may include one outlet or more than one outlet so that the device can be used by more than one consumer at a time. Use of shisha devices is considered by many to be a leisure activity and a social experience. The tobacco used in shisha devices may be mixed with other ingredients to, for example, increase the volume of the vapour and smoke produced, to alter flavour, or both.

It is desirable to provide a shisha consumable article for an external assembly, such as a shisha assembly, that employs a tobacco substrate or aerosol forming substrate and a combustible heat source that is convenient and simple to use and provide a clean experience. It would be desirable to provide a ready-to-use consumable that combines the tobacco substrate or aerosol forming substrate and a combustible heat source in a single consumable article that can provide simple and clean disposal of the consumed article. It would be desirable to provide a ready-to-use consumable where the combustion gases are isolated from the inhalation airflow.

According to an aspect of the invention, a shisha consumable article for use with a shisha assembly includes a housing defining a first compartment and a second compartment being adjacent to the first compartment. The second compartment is adjacent to, and sealed or air impermeable from, the first compartment. A combustible heat source is contained within the first compartment, and an aerosol-forming substrate is contained within the second compartment. Preferably, the aerosol-forming substrate comprises nicotine.

Advantageously, one or both of the first compartment and a second compartment may have an air-tight seal to preserve the combustible heat source or the aerosol-forming substrate or both the combustible heat source and the aerosol-forming substrate. The air-tight seal may be cleanly removed by the consumer prior to consumption of the shisha consumable article. The shisha consumable article may also have the advantage of a simple and clean set-up and disposal of the of the consumed shisha consumable article. There is no charcoal or residues or ash to handle once the shisha consumable article is consumed.

The shisha consumable article second compartment is sealed or air impermeable from the first compartment. In this configuration, the combustible heat source can be referred to as "blind". The inhalation air or the aerosol-forming substrate is heated substantially or entirely by heat conducted through physical contact from the combustible heat source rather than by convection. Preferably, the thermal conduction is by indirect thermal contact from the heat source to the aerosol-forming substrate.

Advantageously, this configuration can prevent or reduce combustion gas from the combustible heat source from being inhaled with the smoke or aerosol formed from the aerosol-forming material. De-coupling the inhalation air from the combustion air improves the uniformity of heat generation and prevents spikes in temperature of the aerosol-forming substrate during inhalation cycles by the user. This can minimize any combustion or pyrolysis of the aerosol-forming substrate under intense inhalation cycles by the user. This configuration may be provided in a convenient package that contains both the combustible heat source and the aerosol-forming substrate.

According to an aspect of the invention, a shisha assembly includes, a vessel defining an interior configured to contain a volume of liquid and a vessel head space outlet conduit, a shisha consumable receptacle comprising an aerosol air outlet, a conduit in gaseous communication with the aerosol air outlet and the interior of the vessel, a shisha consumable article, described herein, is disposed on the shisha consumable receptacle. The shisha consumable receptacle aerosol air outlet mating with an aerosol air outlet exposed or formed through the second compartment housing.

Advantageously, this assembly is simple and convenient to use. A user mates the shisha consumable article, described herein, onto the shisha consumable receptacle and the receptacle aerosol outlet is aligned with the shisha consumable article aerosol outlet and one more air inlets on the shisha consumable receptacle are aligned with one or more air inlets in the shisha consumable article. Once the shisha consumable article is consumed, and optionally cooled, the consumed article can be simply discarded, without contacting charcoal, residues or ash.

In some embodiments, the shisha consumable receptacle includes piercing element that form the one more air inlets on the shisha consumable receptacle or the shisha consumable article aerosol outlet or form both the one more air inlets and aerosol outlet on the shisha consumable article. The piercing element may puncture a sealing layer or foil layer forming at least a portion of the shisha consumable receptacle housing.

Preferably the one more air inlets on the shisha consumable receptacle are not in gaseous communication with the carbonaceous heat source. As stated above, this configuration can prevent or reduce combustion gas from the carbonaceous heat source from being inhaled with the smoke or aerosol formed from the aerosol-forming material. De-coupling the inhalation air from the combustion air improves the uniformity of heat generation and prevents spikes in temperature of the aerosol-forming substrate during inhalation cycles by the user. This can minimize any combustion or pyrolysis of the aerosol-forming substrate under intense inhalation cycles by the user.

The term "aerosol-forming substrate" refers to a substrate capable of releasing, upon heating, volatile compounds, which may form an aerosol. The aerosols generated from aerosol-forming substrates of articles according to the invention may be visible or invisible and may include vapours (for example, fine particles of substances, which are in a gaseous state, that are ordinarily liquid or solid at room temperature) as well as gases and liquid droplets of condensed vapours.

Preferably, the aerosol-forming substrate includes nicotine or a nicotine source. Preferably, the nicotine comes from tobacco material. The aerosol-forming material is preferably solid and made from tobacco leaf material. Any suitable aerosol-generating substrate may be used with the shisha consumable article and shisha assembly. The aerosol-generating substrate may be solid, liquid gel or comprise more than one of a solid, liquid or gel component.

The aerosol-forming substrate may include or be formed of non-tobacco materials. Non-tobacco materials include herb leaf, or spices or other material utilized in conjunction with a shisha assembly.

The terms 'distal', 'upstream', 'top', and 'front', and 'proximal', 'downstream', 'bottom' and 'rear', are used to describe the relative positions of components, or portions of components, of the consumable article.

The term "carbonaceous" refers to a material that comprises carbon.

This disclosure relates to a shisha consumable article containing a combustible heat source and an aerosol-forming substrate. The shisha consumable article may be for use with an external assembly such as a shisha assembly. The shisha consumable article includes a housing defining a first compartment and a second compartment being adjacent to the first compartment. The second compartment is adjacent to, and sealed or air impermeable from, the first compartment. A combustible heat source is contained within the first compartment, and an aerosol-forming substrate (preferably containing nicotine or tobacco material) is contained within the second compartment. This disclosure also relates to an assembly that includes a shisha consumable receptacle that mates with the shisha consumable article described herein. The assembly may be a smoking article such as a shisha assembly or a handheld device. Preferably the combustible heat source contained within the first compartment is 'blind' combustible heat source where in use combustion gas does not contact the aerosol-forming substrate or combine with the inhalation air.

The shisha consumable article may take a variety of forms from simple to complex. The shisha consumable article includes an aerosol-forming substrate adjacent to and packaged with a carbonaceous heat source and placed and disposed of as a single integrated article. Combustion gas from the carbonaceous heat source does not contact the inhalation air or the aerosol-forming substrate.

One embodiment includes an aerosol-forming substrate and a combustible heat source fixed to opposing sides of a non-combustible layer. The non-combustible layer may be formed of a glass or metal. The non-combustible layer is a solid air impermeable layer. This layered article may be packaged in a sealed packet (where both the first and second compartment are sealed with air impermeable material) that the consumer can remove prior to placing the shisha consumable article onto the shisha consumable receptacle of a smoking assembly or device. Once consumed, the layered article may be discarded without contacting charcoal, residues or ash.

A further embodiment includes an aerosol-forming substrate contained within a sealed housing and the combustible heat source fixed to a top surface of the sealed housing. A housing may be disposed about the combustible heat source that may be fully or partially be removed to expose at least a portion of the combustible heat source for ignition by a user. This stacked article can be placed onto the shisha consumable receptacle of the smoking assembly or device. The air inlets and aerosol outlet can be formed by piercing elements on the shisha consumable receptacle or mated with the air inlets and aerosol outlet on the shisha consumable receptacle. Once consumed, this shisha consumable article may be discarded without contacting charcoal, residues or ash. The housing or lid may be applied to contain the spent combustible heat source.

A further embodiment includes an aerosol-forming substrate contained within a sealed housing forming an annular ring and the combustible heat source disposed within an inner diameter of the annular ring. A housing may be disposed about the combustible heat source that may be fully or partially be removed to expose at least a portion of the combustible heat source for ignition by a user. This annular article can be placed onto the shisha consumable receptacle of the smoking assembly or device. The air inlets and aerosol outlet can be formed by piercing elements on the shisha consumable receptacle or mated with the air inlets and aerosol outlet on the shisha consumable receptacle. Once consumed, this shisha consumable article may be discarded without contacting charcoal, residues or ash. The housing or lid may be applied to contain the spent combustible heat source.

A further embodiment includes a housing containing a plurality of aerosol-forming substrates. Each aerosol-forming substrate may be contained within a second compartment. The aerosol-forming substrate may be radially placed about the shisha consumable article. A single combustible heat source can be placed on top of each second compartment. Each aerosol-forming substrate may be consumed sequentially by selectively igniting respective combustible heat sources sequentially. This multiple substrate article can be placed onto the shisha consumable receptacle of the smoking assembly or device. The air inlets and aerosol outlet can be formed by piercing elements on the shisha consumable receptacle or mated with the air inlets and aerosol outlet on the shisha consumable receptacle. In some embodiments the shisha consumable article may be rotated to align the aerosol-forming substrate and respective combustible heat sources for ignition and consumption. Once consumed, this shisha consumable article may be discarded without contacting charcoal, residues or ash. The housing or lid may be applied to contain the spent carbonaceous heat source.

Preferably, the combustible heat source is a carbonaceous heat source. As used herein, the term 'carbonaceous' is used to describe a combustible heat source comprising carbon. Preferably, combustible carbonaceous heat sources for use in shisha consumable articles according to the invention have a carbon content of at least about 35 percent, more preferably of at least about 40 percent, most preferably of at least about 45 percent by dry weight of the combustible heat source.

In some embodiments, the combustible heat sources according to the invention are combustible carbon-based heat sources. As used herein, the term 'carbon-based heat source' is used to describe a heat source comprised primarily of carbon.

Combustible carbon-based heat sources for use in shisha consumable articles according to the invention have a carbon content of at least about 50 percent. For example, combustible carbon-based heat sources for use in shisha consumable articles according to the invention may have a carbon content of at least about 60 percent, or at least about 70 percent, or at least about 80 percent by dry weight of the combustible carbon-based heat source.

Shisha consumable articles according to the invention may comprise combustible carbonaceous heat sources formed from one or more suitable carbon-containing materials.

If desired, one or more binders may be combined with the one or more carbon-containing materials. Preferably, the one or more binders are organic binders. Suitable known organic binders, include but are not limited to, gums (for example, guar gum), modified celluloses and cellulose derivatives (for example, methyl cellulose, carboxymethyl cellulose, hydroxypropyl cellulose and hydroxypropyl methylcellulose) flour, starches, sugars, vegetable oils and combinations thereof.

In one preferred embodiment, the combustible heat source is formed from a mixture of carbon powder, modified cellulose, flour and sugar. Instead of, or in addition to one or more binders, combustible heat sources for use in shisha consumable articles according to the invention may comprise one or more additives in order to improve the properties of the combustible heat source. Suitable additives include, but are not limited to, additives to promote consolidation of the combustible heat source (for example, sintering aids), additives to promote ignition of the combustible heat source (for example, oxidisers such as perchlorates, chlorates, nitrates, peroxides, permanganates, zirconium and combinations thereof), additives to promote combustion of the combustible heat source (for example, potassium and potassium salts, such as potassium citrate) and additives to promote decomposition of one or more gases produced by combustion of the combustible heat source (for example catalysts, such as CuO, $Fe_2O_3$ and $Al_2O_3$).

In certain preferred embodiments, the combustible heat source is a combustible carbonaceous heat source comprising carbon and at least one ignition aid. In one preferred embodiment, the combustible heat source is a combustible carbonaceous heat source comprising carbon and at least one ignition aid as described in WO-A1-2012/164077.

As used herein, the term 'ignition aid' is used to denote a material that releases one or both of energy and oxygen during ignition of the combustible heat source, where the rate of release of one or both of energy and oxygen by the material is not ambient oxygen diffusion limited. In other words, the rate of release of one or both of energy and oxygen by the material during ignition of the combustible heat source is largely independent of the rate at which ambient oxygen can reach the material. As used herein, the term 'ignition aid' is also used to denote an elemental metal that releases energy during ignition of the combustible heat source, wherein the ignition temperature of the elemental metal is below about 500° C. and the heat of combustion of the elemental metal is at least about 5 kJ/g.

As used herein, the term 'ignition aid' does not include alkali metal salts of carboxylic acids (such as alkali metal citrate salts, alkali metal acetate salts and alkali metal succinate salts), alkali metal halide salts (such as alkali metal chloride salts), alkali metal carbonate salts or alkali metal phosphate salts, which are believed to modify carbon combustion. Even when present in a large amount relative to the total weight of the combustible heat source, such alkali metal burn salts do not release enough energy during ignition of a combustible heat source to produce an acceptable aerosol during early puffs.

Examples of suitable oxidizing agents include, but are not limited to: nitrates such as, for example, potassium nitrate, calcium nitrate, strontium nitrate, sodium nitrate, barium nitrate, lithium nitrate, aluminium nitrate and iron nitrate; nitrites; other organic and inorganic nitro compounds; chlorates such as, for example, sodium chlorate and potassium chlorate; perchlorates such as, for example, sodium perchlorate; chlorites; bromates such as, for example, sodium bromate and potassium bromate; perbromates; bromites; borates such as, for example, sodium borate and potassium borate; ferrates such as, for example, barium ferrate; ferrites; manganates such as, for example, potassium manganate; permanganates such as, for example, potassium permanganate; organic peroxides such as, for example, benzoyl peroxide and acetone peroxide; inorganic peroxides such as, for example, hydrogen peroxide, strontium peroxide, magnesium peroxide, calcium peroxide, barium peroxide, zinc peroxide and lithium peroxide; superoxides such as, for example, potassium superoxide and sodium superoxide; iodates; periodates; iodites; sulphates; sulfites; other sulfoxides; phosphates; phospinates; phosphites; and phosphanites.

While advantageously improving the ignition and combustion properties of the combustible heat source, the inclusion of ignition and combustion additives can give rise to undesirable decomposition and reaction products during use of the nic shisha otine consumable article. For example, decomposition of nitrates included in the combustible heat source to aid ignition thereof can result in the formation of nitrogen oxides. The inclusion of a combustible heat source in shisha consumable articles according to the invention advantageously substantially prevents or inhibits such decomposition and reaction products from entering air drawn through shisha consumable articles according to the invention during use thereof.

Combustible carbonaceous heat sources for use in smoking articles according to the invention may be prepared as described in prior art that is known to persons of ordinary skill in the art.

Combustible carbonaceous heat sources for use in shisha consumable articles according to the invention, are preferably formed by mixing one or more carbon-containing materials with one or more binders and other additives, where included, and pre-forming the mixture into a desired shape. The mixture of one or more carbon containing materials, one or more binders and optional other additives may be pre-formed into a desired shape using any suitable known ceramic forming methods such as, for example, slip casting, extrusion, injection moulding and die compaction or pressing. In certain preferred embodiments, the mixture is pre-formed into a desired shape by pressing or extrusion or a combination thereof.

The mixture of one or more carbon-containing materials, one or more binders and other additives may be formed into a disk or pellet shape. However, it will be appreciated that the mixture of one or more carbon-containing materials, one or more binders and other additives may be pre-formed into other desired shapes.

After formation, particularly after extrusion, the thick disk or other desired shape is preferably dried to reduce its moisture content and then pyrolysed in a non-oxidizing atmosphere at a temperature sufficient to carbonise the one or more binders, where present, and substantially eliminate any volatiles in the disk or other shape. The disk or other desired shape is pyrolysed preferably in a nitrogen atmosphere at a temperature of between about 700° C. and about 900° C. In certain embodiments, at least one metal nitrate salt is incorporated in the combustible heat source by including at least one metal nitrate precursor in the mixture of one or more carbon containing materials, one or more binders and other additives. The at least one metal nitrate precursor is then subsequently converted in-situ into at least one metal nitrate salt by treating the pyrolysed pre-formed cylindrical rod or other shape with an aqueous solution of nitric acid. In one embodiment, the combustible heat source comprises at least one metal nitrate salt having a thermal decomposition temperature of less than about 600° C., more preferably of less than about 400° C. Preferably, the at least one metal nitrate salt has a decomposition temperature of between about 150° C. and about 600° C., more preferably of between about 200° C. and about 400° C.

In preferred embodiments, exposure of the combustible heat source to a conventional yellow flame lighter or other ignition means should cause the at least one metal nitrate salt to decompose and release oxygen and energy. This decomposition causes an initial boost in the temperature of the combustible heat source and also aids in the ignition of the combustible heat source. After decomposition of the at least one metal nitrate salt, the combustible heat source preferably continues to combust at a lower temperature.

The inclusion of at least one metal nitrate salt advantageously results in ignition of the combustible heat source being initiated internally, and not only at a point on the surface thereof. Preferably, the at least one metal nitrate salt is present in the combustible heat source in an amount of between about 20 percent by dry weight and about 50 percent by dry weight of the combustible heat source.

In other embodiments, the combustible heat source comprises at least one peroxide or superoxide that actively evolves oxygen at a temperature of less than about 600° C., more preferably at a temperature of less than about 400° C. Preferably, the at least one peroxide or superoxide actively evolves oxygen at a temperature of between about 150° C. and about 600° C., more preferably at a temperature of between about 200° C. and about 400° C., most preferably at a temperature of about 350° C.

In use, exposure of the combustible heat source to a conventional yellow flame lighter or other ignition means should cause the at least one peroxide or superoxide to decompose and release oxygen. This causes an initial boost in the temperature of the combustible heat source and also aids in the ignition of the combustible heat source. After decomposition of the at least one peroxide or superoxide, the combustible heat source preferably continues to combust at a lower temperature.

The inclusion of at least one peroxide or superoxide advantageously results in ignition of the combustible heat source being initiated internally, and not only at a point on the surface thereof. The combustible heat source preferably has a porosity of between about 20 percent and about 80 percent, more preferably of between about 20 percent and 60 percent. Where the combustible heat source comprises at least one metal nitrate salt, this advantageously allows oxygen to diffuse into the mass of the combustible heat source at a rate sufficient to sustain combustion as the at least one metal nitrate salt decomposes and combustion proceeds. Even more preferably, the combustible heat source has a porosity of between about 50 percent and about 70 percent, more preferably of between about 50 percent and about 60 percent as measured by, for example, mercury porosimetry or helium pycnometry. The required porosity may be readily achieved during production of the combustible heat source using conventional methods and technology.

Advantageously, combustible carbonaceous heat sources for use in shisha consumable articles according to the invention have an apparent density of between about 0.6 $g/cm^3$ and about 1 $g/cm^3$. In some embodiments, the combustible heat source has a mass of between about 1 gram and about 10 grams.

The combustible heat source contained within the first compartment is preferably 'blind'. As used herein, the term 'blind' describes a heat source configuration comprising a combustible heat source contained within a first compartment that does not have any inhalation air flow pathway from the first compartment to the aerosol-forming substrate. In a blind combustible heat source configuration, heat transfer from the combustible heat source to the aerosol-forming substrate occurs primarily by conduction. Preferably, heating of the aerosol-forming substrate by forced convection is minimized or reduced. The lack of any airflow pathway from the first compartment to the blind combustible heat source advantageously can substantially prevent or inhibit spikes in the temperature of the aerosol-forming substrate during puffing by a user. By preventing or inhibiting excess temperature increases in the aerosol-forming substrate, combustion or pyrolysis of the aerosol-forming substrate under intense puffing regimes may be advantageously avoided. In addition, the impact of a user's puffing regime on the composition of the aerosol may be advantageously minimized or reduced. The inclusion of a blind combustible heat source may also advantageously substantially prevent or inhibit combustion and decomposition products and other materials formed during ignition and combustion of the blind combustible heat source from entering air drawn through the shisha consumable article during use thereof.

In some embodiments, the shisha consumable article may comprise a first compartment and at least one inhalation airflow pathway, which provides at least one or more airflow pathways from the first compartment to the aerosol-forming substrate. The aerosol-forming substrate is heated by forced convection through the inhalation airflow pathway from air in the first compartment by the user puffing. In such embodiments, the heat source may be referred to as 'non-blind'. The term 'non-blind' describes a heat source configuration comprising a combustible heat source contained within a first compartment that has at least one inhalation airflow pathway from the first compartment to the aerosol-forming substrate.

The aerosol-forming substrate comprises at least one aerosol-former and a material capable of releasing volatile compounds in response to heating. The aerosol-forming substrate may comprise other additives and ingredients including, but not limited to, humectants, flavourants, binders and mixtures thereof. Preferably, the aerosol-forming substrate comprises nicotine. More preferably, the aerosol-forming substrate comprises tobacco.

The at least one aerosol-former may be any suitable known compound or mixture of compounds that, in use, facilitates formation of a dense and stable aerosol and that is substantially resistant to thermal degradation at the operating temperature of the aerosol generating article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in aerosol generating articles herein are polyhydric alcohols or mixtures thereof, such as triethylene glycol, 1,3-butanediol and, most preferred, glycerine.

The material capable of emitting volatile compounds in response to heating may be a charge of plant-based material. The material capable of emitting volatile compounds in response to heating may be a charge of homogenised plant-based material. For example, the aerosol-forming substrate may comprise one or more materials derived from plants including, but not limited to: tobacco; tea, for example green tea; peppermint; laurel; *eucalyptus*; basil; sage; *verbena*; and tarragon. Preferably, the material capable of emitting volatile compounds in response to heating is a charge of tobacco-based material, most preferably a charge of homogenised tobacco-based material. The material capable of emitting volatile compounds or aerosol forming substrate may include non-tobacco solid materials such as herbs, spices and the like.

Preferably, the aerosol-forming substrate has a mass of between about 1 gram and about 5 grams, more preferably of between about 1.5 grams and about 3 grams.

Shisha consumable articles described herein may comprise one or more air inlets around the periphery of the aerosol-forming substrate compartment. In such embodiments, in use, cool air is drawn into the aerosol-forming substrate through the air inlets. The air drawn into the aerosol-forming substrate through the air inlets passes downstream through the aerosol-forming substrate and exits the shisha consumable articles through an aerosol outlet. In smoking devices, the aerosol continues through a mouthpiece to the consumer. In shisha embodiment, the aerosol continues into a volume of water and to a shisha mouthpiece to the consumer.

During inhalation by a user, the cool air drawn through the one or more air inlets around the aerosol-forming substrate advantageously reduces the temperature of the aerosol-forming substrate. This advantageously substantially prevents or inhibits spikes in the temperature of the aerosol-forming substrate during inhalation by a user. As used herein, the term 'cool air' is used to describe ambient air that is not significantly heated by the combustible heat source upon inhalation by a user.

Shisha consumable articles described herein may comprise a heat-conducting element around and in direct contact with both at least the combustible heat source and the aerosol-forming substrate. The heat-conducting element provides a thermal link between the combustible heat source and the aerosol-forming substrate and advantageously helps to facilitate adequate heat transfer from the combustible heat source to the aerosol-forming substrate to provide an acceptable aerosol. Preferably the heat-conducting element forms at least a portion of the housing of the shisha consumable article, preferably the housing defining at least a portion of the second compartment. Suitable heat-conducting elements for use herein include, but are not limited to: metal or metal foil such as, for example, aluminum foil, steel, iron foil and copper foil; and metal alloy foil.

All scientific and technical terms used herein have meanings commonly used in the art unless otherwise specified. The definitions provided herein are to facilitate understanding of certain terms used frequently herein.

The terms "upstream" and "downstream" refer to relative positions of elements of the aerosol generating article described in relation to the direction of inhalation air flow as it is drawn through the body of the aerosol generating article from a distal portion to the mouthpiece portion.

As used herein, the singular forms "a", "an", and "the" encompass embodiments having plural referents, unless the content clearly dictates otherwise.

As used herein, "or" is generally employed in its sense including "and/or" unless the content clearly dictates otherwise. The term "and/or" means one or all of the listed elements or a combination of any two or more of the listed elements.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

The schematic drawings are not necessarily to scale and are presented for purposes of illustration and not limitation. The drawings depict one or more aspects described in this disclosure. However, it will be understood that other aspects not depicted in the drawing fall within the scope and spirit of this disclosure.

Figure 4:
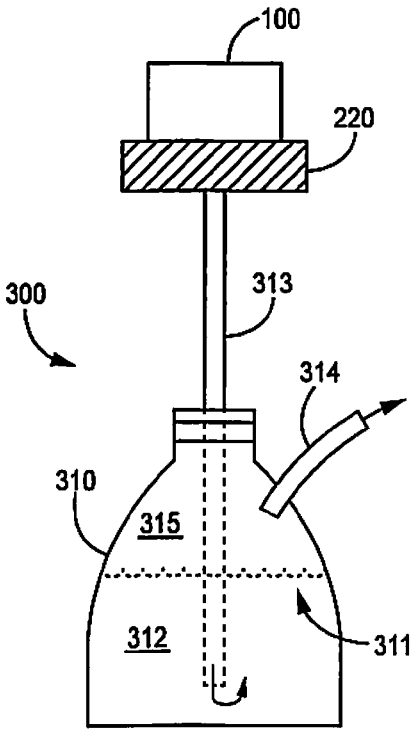

FIG. 4 is a schematic diagram of illustrative shisha assembly 300. The shisha assembly 300 includes a vessel 310 defining an interior 311 configured to contain a volume of liquid 312 and a vessel head space 316 outlet conduit 314. A shisha consumable receptacle 220 includes an aerosol air outlet. A conduit 313 in gaseous communication with the aerosol air outlet and the interior 311 of the vessel 310. A shisha consumable article 100, described herein, is disposed on the shisha consumable receptacle 220. The shisha consumable receptacle aerosol air outlet mating with an aerosol air outlet exposed or formed through the second compartment housing.

Figure 5A:
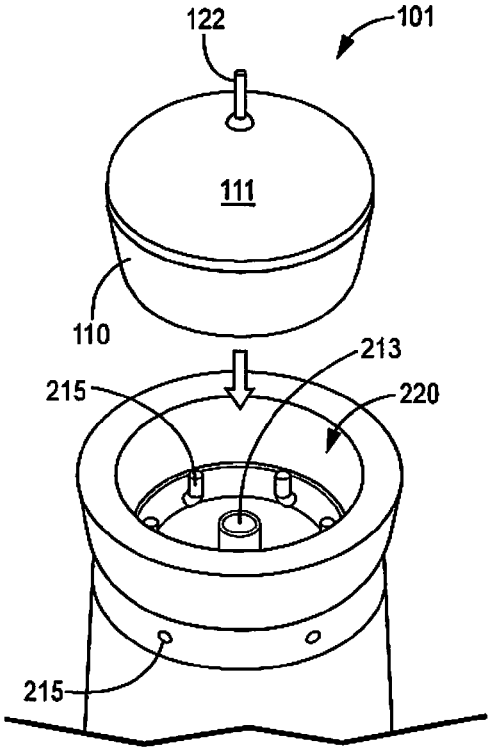
Figure 5B:
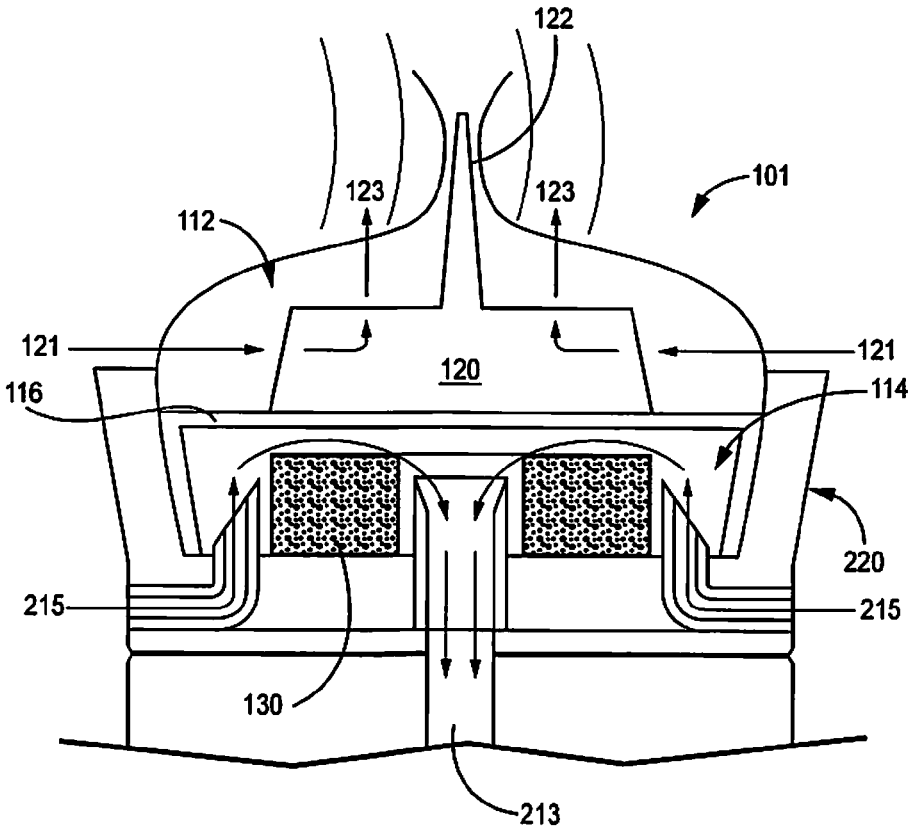

FIG. 5A is a perspective schematic view of a shisha consumable article 101 being inserted into a shisha consumable receptacle 220. FIG. 5B is a cross-sectional diagram of the illustrative shisha consumable article 101 engaged within the shisha consumable receptacle 220.

Figure 6A:
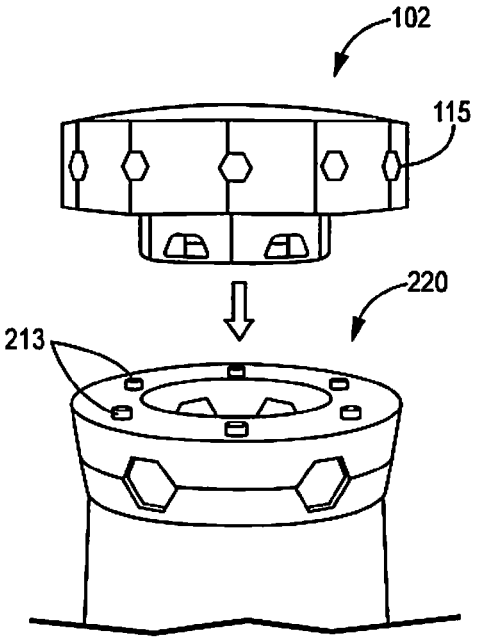
Figure 6B:
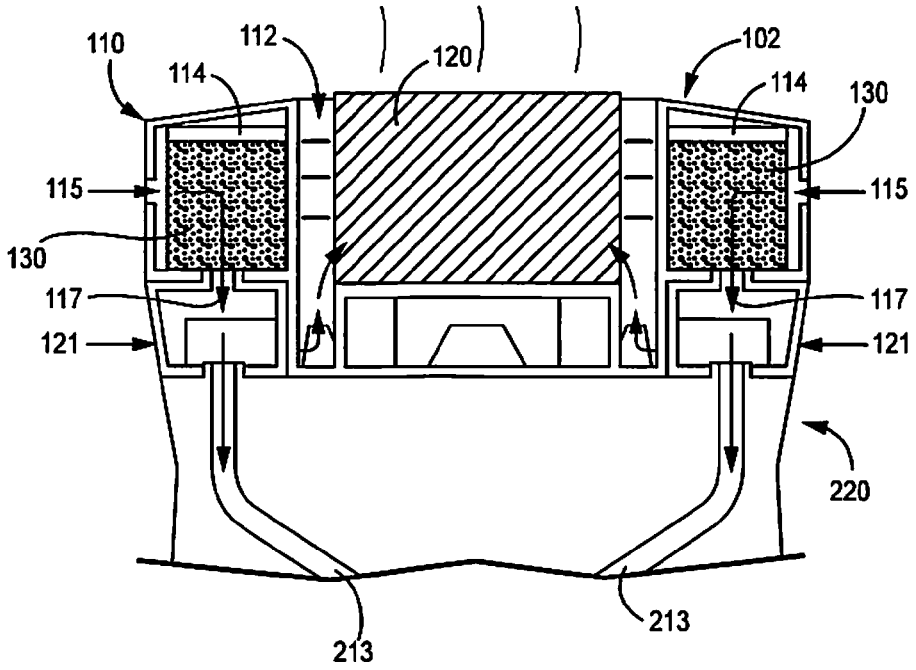

FIG. 6A is a perspective schematic view of a shisha consumable article 102 being inserted into a shisha consumable receptacle 220. FIG. 6B is a cross-sectional diagram of the illustrative shisha consumable article 102 engaged within the shisha consumable receptacle 220.

Figure 7A:
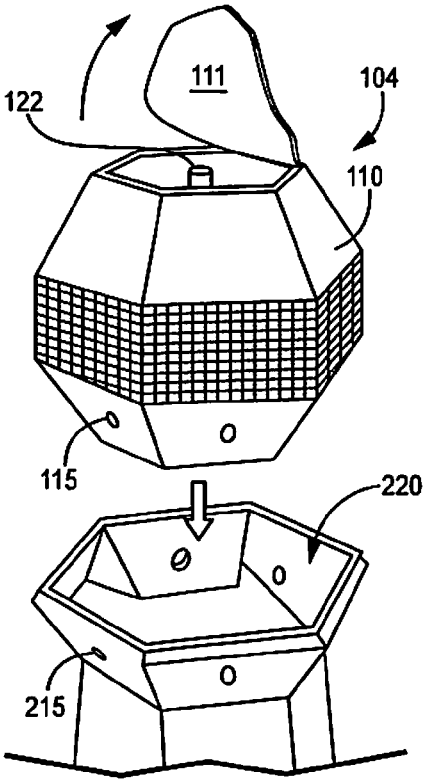
Figure 7B:
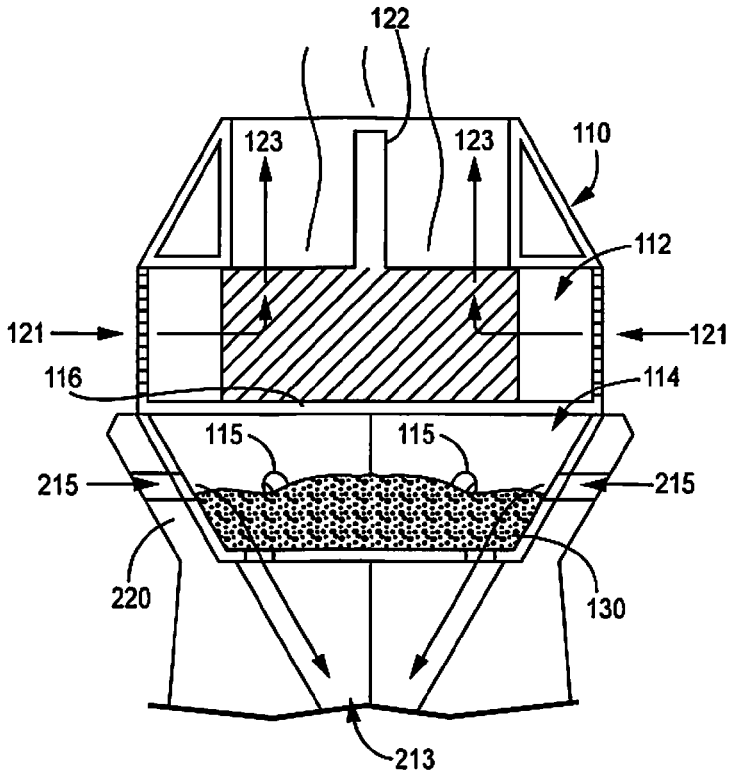

FIG. 7A is a perspective schematic view of a shisha consumable article 104 being inserted into a shisha consumable receptacle 220. FIG. 7B is a cross-sectional diagram of the illustrative shisha consumable article 104 engaged within the shisha consumable receptacle 220.

Figure 8A:
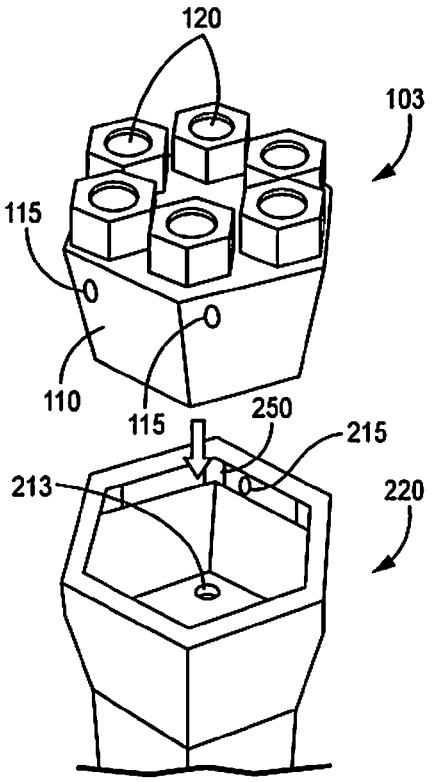
Figure 8B:
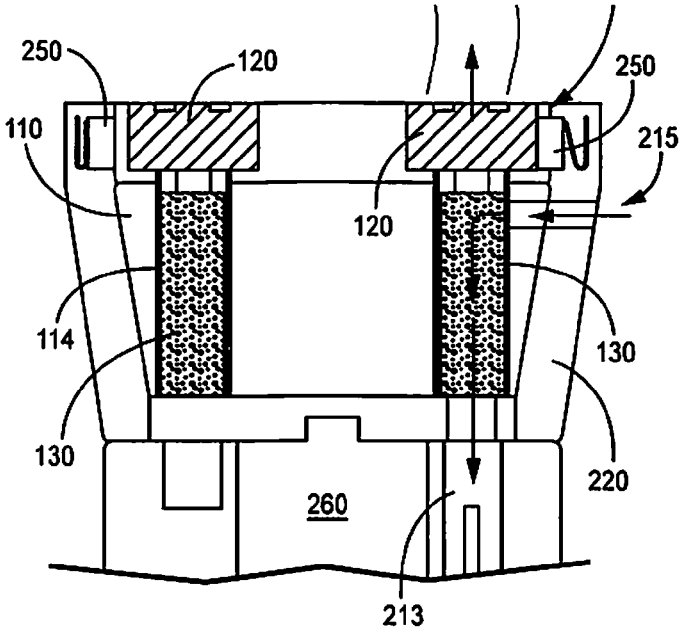

FIG. 8A is a perspective schematic view of a shisha consumable article 103 being inserted into a shisha consumable receptacle 220. FIG. 8B is a cross-sectional diagram of the illustrative shisha consumable article 103 engaged within the shisha consumable receptacle 220.

Figure 9A:
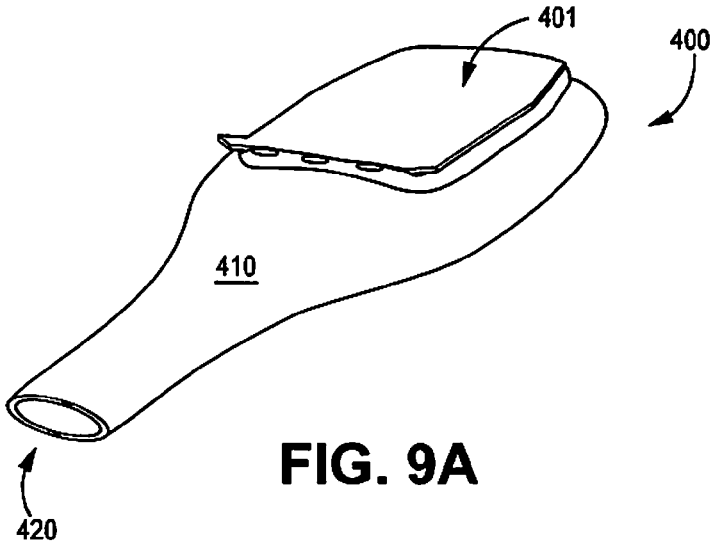
Figure 9B:
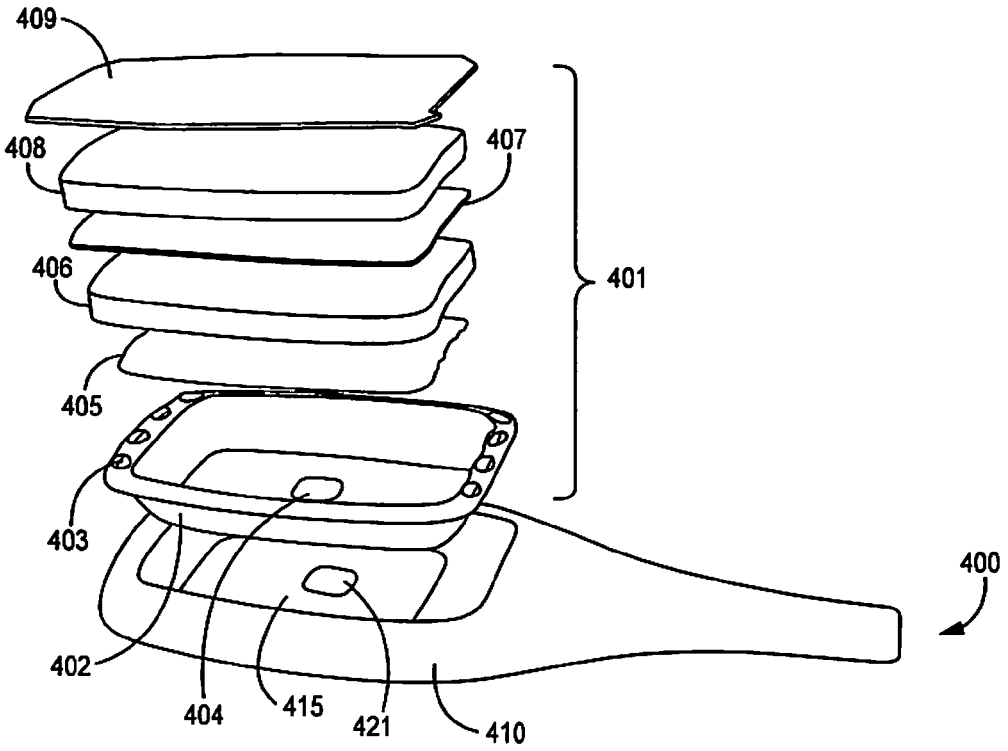

FIG. 9A is a perspective schematic view of a smoking device 400 including the shisha consumable article 401 inserted into a shisha consumable receptacle 415. FIG. 9B is an exploded perspective diagram of the illustrative smoking device 400 and shisha consumable article 401.

The shisha consumable article 101, 102, 103, 104 includes a housing 110 defining a first compartment 112 and a second compartment 114 being adjacent to the first compartment. A combustible heat source 120 is contained within the first compartment 112, and an aerosol-forming substrate 130 is contained within the second compartment 114. An optional sealing or seal layer 111 may be cleanly removed by the consumer prior to consumption of the shisha consumable article. The removed seal layer 111 can expose at least a portion of the combustible heat source 120.

Figure 1:
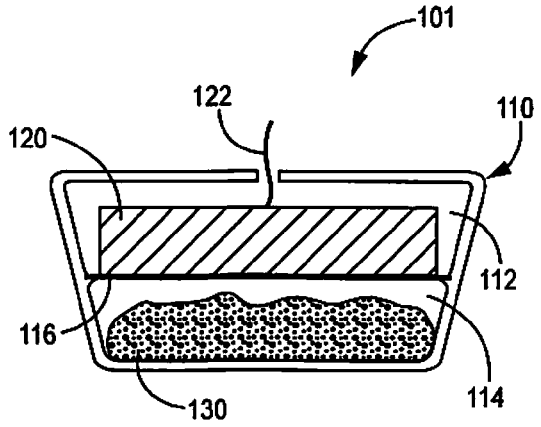
FIG. 1 is schematic cross-sectional diagram of illustrative shisha consumable article 101.

FIG. 1 and FIG. 5B and FIG. 7B illustrate the first compartment 112 forming a top portion of the shisha consumable article 101, 104 and the second compartment 114 forming a bottom portion of the shisha consumable article 101, 104. A bottom wall 116 of the first compartment 112 forms a top wall 116 of the second compartment 114. This solid wall or layer 116 seals the first compartment 112 from the second compartment 114. The solid layer 116 conducts heat from the combustible heat source 120 to the second compartment 114. Thus, the first compartment 112 is sealed or air impermeable from the second compartment 114.

FIGS. 5A and 5B and FIGS. 7A and 7B illustrate the placement and use of the shisha consumable article 101, 104 into a shisha consumable receptacle 220. An optional wick 122 can be lit to ignite the combustible heat source 120. The receptacle aerosol air outlet 213 can pierce the housing forming the second compartment 114 or mate with the aerosol outlet of the second compartment 114. The receptacle air inlets 215 can pierce the housing forming the second compartment 114 or mate with the air inlet of the second compartment 114. Combustible heat source 120 airflow 121, 123 is separate and decoupled from the cool air or inhalation airflow 215, 213 through the second compartment 114 and aerosol-forming substrate 130.

Figure 2A:
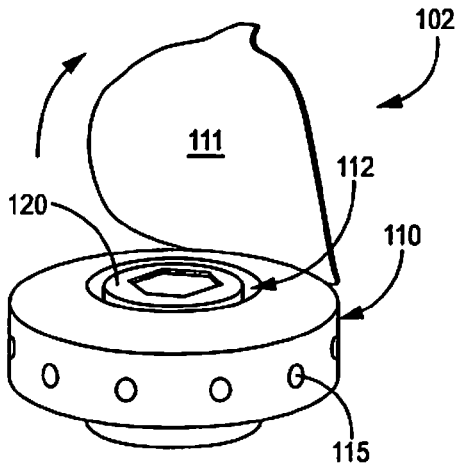
FIG. 2A is a schematic perspective diagram of another illustrative shisha consumable article 102 and FIG. 2B is a cross-sectional diagram of the illustrative shisha consumable article 102.
Figure 2B:
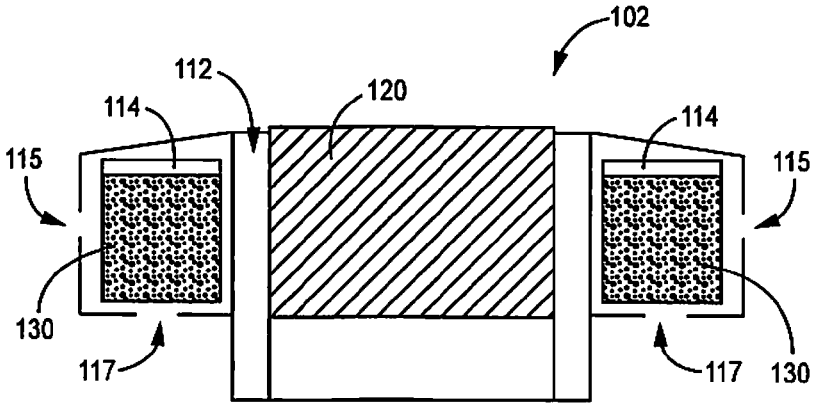

FIG. 2A and FIG. 2B illustrate the second compartment 114 forming an annular ring portion of the shisha consumable article 102 and the first compartment 112 forming an inner compartment within the inner diameter of the annular ring 114. This annular ring seals the first compartment 112 from the second compartment 114. Second compartment air inlets 115 can be sealed prior to consuming the shisha consumable article 102

FIGS. 6A and 6B illustrate the placement and use of the shisha consumable article 102, into a shisha consumable receptacle 220. The receptacle aerosol air outlet 213 can pierce the housing forming the second compartment 114 or mate with the aerosol outlet of the second compartment 114. Combustible heat source 120 airflow 121 is separate and decoupled from the cool air or inhalation airflow 115, 117 through the second compartment 114 and aerosol-forming substrate 130.

Figure 3A:
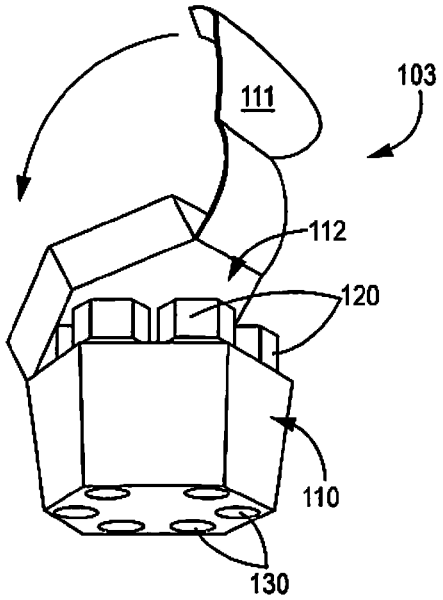
FIG. 3A is a schematic perspective diagram of another illustrative shisha consumable article 103 and FIG. 3B is a cross-sectional diagram of the illustrative shisha consumable article 103.
Figure 3B:
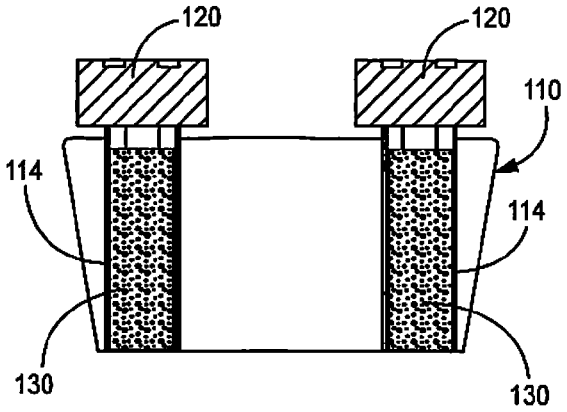

FIG. 3A and FIG. 3B illustrate the first compartment 112 forming a top portion of the shisha consumable article 103 and the second compartment 114 forming a bottom portion of the shisha consumable article 103. The housing 110 defines a plurality of second compartments 114 and each second compartment 114 contains an aerosol-forming substrate 130. In many embodiments, a combustible heat source 120 is associated with each respective aerosol-forming substrate 130. While these figures illustrate six aerosol-forming substrates 130, the shisha consumable article 103 can contain any number of aerosol-forming substrates 130. The sealing or seal layer 111 may contain the combustible heat source 120 and form the first compartment 112. The sealing or seal layer 111 may be partially or completely removed.

FIGS. 8A and 8B illustrate the placement and use of the shisha consumable article 103 into a shisha consumable receptacle 220. The receptacle aerosol air outlet 213 can pierce the housing forming the second compartment 114 or mate with the aerosol outlet of the second compartment 114. An electrical igniter 250 may be included on the shisha consumable receptacle 220. The aerosol-forming substrate 130 may be individually and sequentially consumed and rotated about the axis 260 to align each aerosol-forming substrate 130 with the aerosol outlet 213 and ignited combustible heat source 120.

FIGS. 9A and 9B illustrate an exemplary handheld smoking device 400. The smoking device 400 includes a housing that defines a mouthpiece 420 and a shisha consumable receptacle 415. An aerosol outlet 421 in the shisha consumable receptacle 415 may mate with an aerosol outlet 404 in the shisha consumable article 401 to allow aerosol to flow from the shisha consumable article 401 to the mouthpiece 420. The shisha consumable article 401 may be replaceable into the shisha consumable receptacle 415 of the smoking device 400.

The shisha consumable article 401 may be a layered structure that includes a housing 402 defining a first compartment (containing the aerosol-forming substrate 406) and a second compartment (containing the combustible heat source 408). A sealing or seal layer 407 may separate the aerosol-forming substrate 406 from the combustible heat source 408. This sealing or seal layer 407 is a solid wall or layer that seals the first compartment (containing the aerosol-forming substrate 406) from the second compartment (containing the combustible heat source 408). The seal layer 407 conducts heat from the combustible heat source 408 to the aerosol-forming substrate 406. Thus, the combustible heat source 408 is sealed or air impermeable from the aerosol-forming substrate 406 and may be referred to as a blind combustible heat source. The seal layer 407 may be a heat-conducting element that is air impermeable. This seal layer or heat-conducting element 407 provides a thermal link between the combustible heat source 408 and the aerosol-forming substrate 406 and advantageously helps to facilitate adequate heat transfer from the combustible heat source 408 to the aerosol-forming substrate 406 to provide an acceptable aerosol. Preferably the heat-conducting element 407 seals to at least a portion of the housing 402 of the shisha consumable article 401. Suitable heat-conducting elements 407 for use herein include, but are not limited to: metal or metal foil such as, for example, aluminum foil, steel, iron foil and copper foil; and metal alloy foil.

A removable seal layer 409 may cover the combustible heat source 408 and may be cleanly removed by the consumer prior to consumption of the shisha consumable article to expose and ignite the combustible heat source 408. Cool air inlets 403 may be formed through the housing 402. The removable seal layer 409 may cover the cool air inlets 403 and aid in preserving the freshness of the material within the shisha consumable article 401. A layer of filter material 405 may be disposed between the aerosol-forming substrate 406 and the aerosol outlet 404 in the shisha consumable article 401.

This shisha consumable article 401 may be packaged in a sealed packet that the consumer can remove prior to placing the shisha consumable article onto the shisha consumable receptacle 415 of a smoking device 400. Once consumed, the shisha consumable article 401 may be discarded without contacting charcoal, residues or ash and an new or fresh shisha consumable article 401 may be inserted into the shisha consumable receptacle 415 of a smoking device 400.

The specific embodiments described above are intended to illustrate the invention. However, other embodiments may be made without departing from the spirit and scope of the invention as defined in the claims, and it is to be understood that the specific embodiments described above are not intended to be limiting.

The invention claimed is:

1. A shisha consumable article for use with a shisha assembly, the shisha consumable article comprising:

a housing defining a first compartment and a second compartment and a first wall between the first and second compartments, the second compartment being adjacent to, and sealed or air impermeable from the first compartment;

a combustible heat source contained within the first compartment;

a seal layer adhered to and covering at least a portion of a second wall of the first compartment, the seal layer cleanly removable to expose at least a portion of the combustible heat source; and an aerosol-forming substrate contained within the second compartment; and wherein the shisha consumable article is configured to be received into a shisha consumable receptacle such that the second compartment is pierced or mated with the shisha consumable receptacle to form an airflow pathway through the second compartment.

2. The shisha consumable article according to claim 1, wherein the second compartment is air impermeable and the first compartment is air impermeable.

3. The shisha consumable article according to claim 1, wherein the first compartment forms a top portion of the shisha consumable article and the second compartment forms a bottom portion of the shisha consumable article, and a bottom wall of the first compartment forms a top wall of the second compartment.

4. The shisha consumable article according to claim 3, wherein a bottom wall of the second compartment is perforated or comprises a plurality of through-holes, enabling air to be drawn through the second compartment during use.

5. The shisha consumable article according to claim 1, wherein the second compartment forms an annular ring and the first compartment forms an inner compartment within an inner diameter of the annular ring.

6. The shisha consumable article according to claim 1, wherein the housing defines a plurality of second compartments, and each second compartment contains an aerosol-forming substrate.

7. The shisha consumable article according to claim 1, wherein the aerosol-forming substrate comprises nicotine.

8. The shisha consumable article according to claim 1, wherein the aerosol-forming substrate comprises tobacco and the combustible heat source is a carbonaceous heat source.

9. The shisha consumable article according to claim 1, wherein the first compartment forms a top portion of the shisha consumable article and the second compartment forms a bottom portion of the shisha consumable article, and a bottom wall of the first compartment forms a top wall of the second compartment.

10. The shisha consumable article according to claim 9, wherein the bottom wall of the second compartment is perforated or comprises a plurality of through-holes, enabling air to be drawn through the second compartment during use.

11. The shisha consumable article according to claim 1, wherein the second compartment forms an annular ring and the first compartment forms an inner compartment within an inner diameter of the annular ring.

12. A shisha assembly, comprising:

a vessel head space outlet conduit contained by an interior of the vessel;

a shisha consumable receptacle comprising an aerosol air outlet;

a conduit in gaseous communication with the aerosol air outlet and the interior of the vessel; and a shisha consumable article, according to claim 1, disposed on the shisha consumable receptacle, the shisha consumable receptacle aerosol air outlet in airflow connection with the second compartment.

13. The shisha assembly according to claim 12, wherein the shisha consumable receptacle comprises a receptacle air inlet that mates with a second compartment air inlet.

* * * * *